United States Patent [19]

Brouwer

[11] 4,087,799

[45] May 2, 1978

[54] PARTICULATE PRODUCTS OF COMBUSTION DETECTOR EMPLOYING SOLID STATE ELEMENTS

[75] Inventor: Frans Brouwer, Glencoe, Ill.

[73] Assignee: Conrac Corporation, New York, N.Y.

[21] Appl. No.: 703,531

[22] Filed: Jul. 8, 1976

[51] Int. Cl.[2] ..... G08B 17/10

[52] U.S. Cl. ..... 340/237.5; 250/574

[58] Field of Search ..... 340/237.5; 250/574; 356/207

[56] References Cited

U.S. PATENT DOCUMENTS

| | | | |
|---|---|---|---|
| 3,316,410 | 4/1967 | Meili et al. | 340/237 S X |
| 3,946,241 | 3/1976 | Malinowski | 340/237 S X |

*Primary Examiner*—John W. Caldwell, Sr.
*Assistant Examiner*—Daniel Myer

[57] ABSTRACT

A particulate products of combustion detector having a light emitting diode and a photovoltaic solar cell coupled one to the other to serve as a particulate or smoke sensor. A free-running multivibrator periodically pulses the light emitting diode to corresponding pulses of light emission having a first pulse-repetition frequency of about 80 Hz. and a duty cycle of about five percent. The output of the solar cell is connected to the input of a ringing amplifier to generate at the amplifier output a ringing pulse sequence having the same pulse-repetition frequency as that of the light element emissions in response to the detection of the particulate products of combustion. The ringing amplifier has a passband of about 500 Hz. centered about a frequency of about 1000 Hz. A detector is connected to the output of the ringing amplifier to generate a peak voltage responsive and proportional to the greatest voltage amplitude of each ringing pulse, namely, that of the first half-cycle of each ringing pulse. A bistable flip-flop is connected to the output of the peak voltage detector. When a peak voltage greater than a threshold magnitude is applied to the flip-flop indicative of the detection of the products of combustion, the circuit is driven to its second stable state, thereby actuating a smoke alarm relay.

8 Claims, 3 Drawing Figures

PARTICULATE PRODUCTS OF COMBUSTION DETECTOR EMPLOYING SOLID STATE ELEMENTS

BACKGROUND OF THE INVENTION

This invention relates to an improved particulate products of combustion or smoke detector, and more particularly to detectors of the type employing solid state elements in an optical detector.

Two types of optical smoke detectors have usually been employed in the prior art to detect smoke. The first type is based on a measurement of the smoke obscuration of light emanating from a light source; and the second type employs the Tyndall effect and is based on a measurement of the light reflected by particles of smoke as the smoke passes through a beam of light emanating from a source of light.

A deficiency of many prior art detectors resided in the type of light sources employed. Non-solid state light sources, such as incandescent or neon lamps have a relatively short life, are brittle and sensitive to shocks. The lamp filament is brittle or the neon electrodes are very close to each other. Moreover, when an optical fire detector includes such a light source, the power supplied to the source is substantial. In a smoke detector installation having a large number of detectors continuously energized, the resulting power consumption becomes prohibitive in this era of higher electricity costs.

Incandescent light sources generally have a very wide spectrum of light emission, much of which is useless because the receiving photocell is responsive to only a small part of this spectrum.

SUMMARY OF THE INVENTION

Accordingly, a principal object of this invention is to employ solid state elements as a light source and as a light detector in a circuit arrangement having a minimum power consumption and a high degree of operative reliability. The particular solid state elements employed are the light emitting diode (LED) and the photovoltaic solar cell. The elements have spectral light output and light response curves which peak at about the same wavelength. Accordingly, improved optical efficiency is attained.

The signal to noise ratio of the smoke detector is substantially increased by energizing the LED with a relatively high current limit for short duration pulses having a pulse-repetition frequency of about 80 Hz. and a duty cycle of about five percent.

These numbers may be modified for very much lower pulse-repetition frequencies and duty cycle. A successful smoke detector has been constructed with a pulse-repetition frequency of 0.4 Hz. and a pulse length of 0.5 millisecond resulting in a duty cycle of 0.02%. The corresponding output signal of the solar cell is applied to a bandpass ringing amplifier having a center frequency substantially above the pulse-repetition frequency of the applied input signal. The amplifier has a center frequency of 1000 Hz. with a passband of about 500 Hz. The use of a solar cell output signal having negligible 1000 Hz. content to create a smoke alarm signal at the output of the bandpass ringing amplifier substantially increases the operative reliability of the smoke detector of this invention.

A detector is connected to the output of the ringing amplifier to generate a peak voltage responsive and proportional to the greatest voltage amplitude of each ringing pulse, namely, that of the first half cycle of each ringing pulse. A bistable flip-flop is connected to the output of the peak voltage detector. When a peak voltage greater than a particular magnitude is applied to the flip-flop indicative of the detection of the products of combustion, the circuit is driven to its second stable state, thereby actuating a smoke alarm relay.

PRIOR ART PATENTS

United States patents employing light emitting diodes in smoke detectors are as follows: U.S. Pat. Nos. 3,846,773 — 3,917,956 — 3,534,351 — 3,922,655 — 3,922,656 and 3,924,252.

DETAILED DESCRIPTION OF THE DRAWINGS

Figure 1:
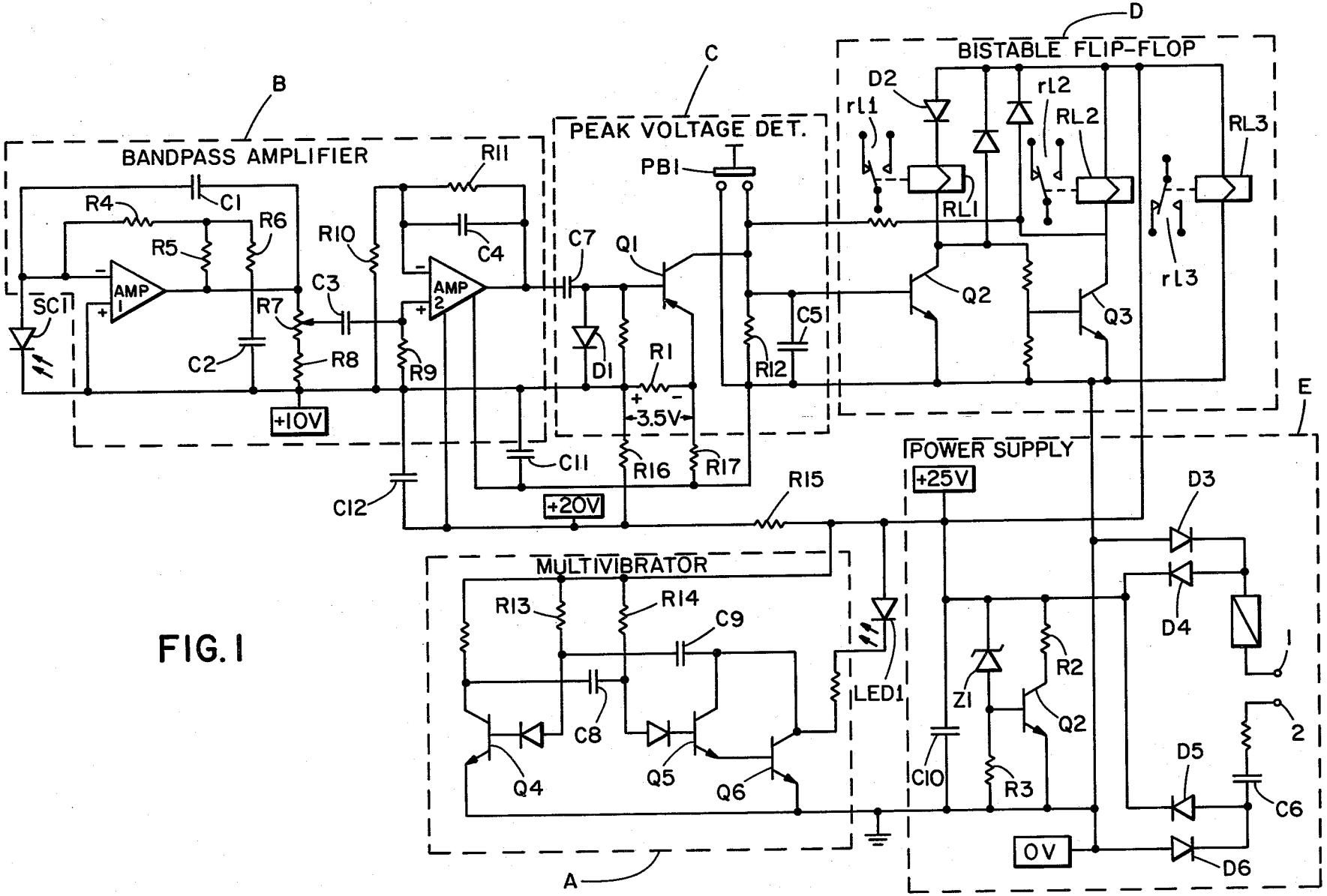
Figure 2:
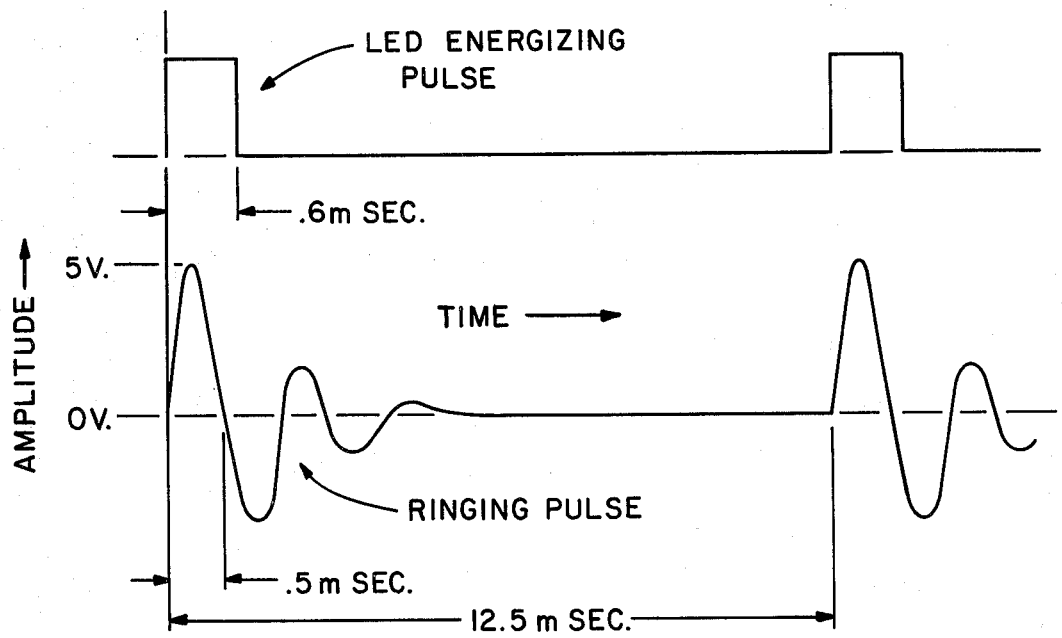
Figure 3:
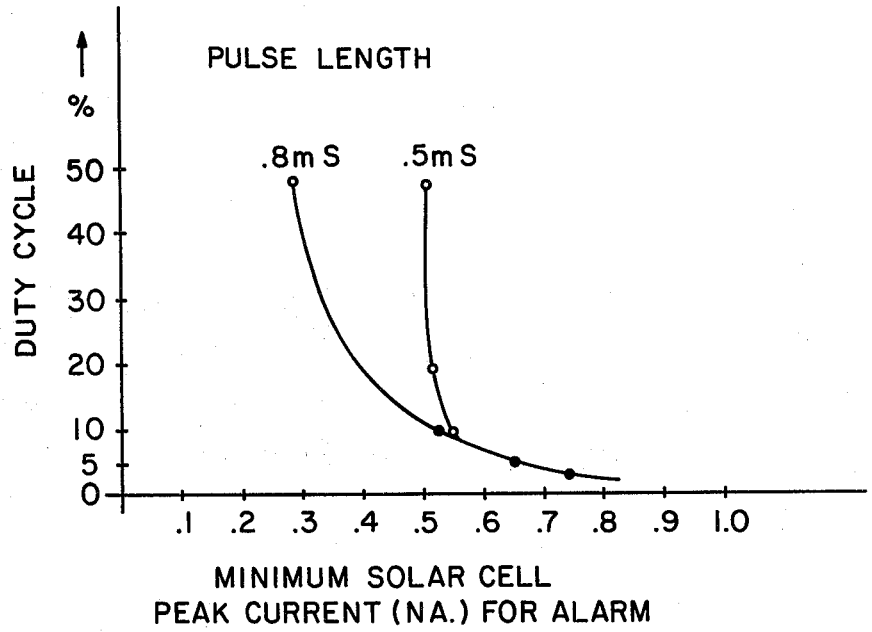

FIG. 1 is a schematic diagram of a preferred circuit embodiment of the smoke detector of this invention, with the circuit being divided by broken-line blocks into its five primary functional elements;

FIG. 2 is a pair of time related waveforms showing the corresponding amplitude relationships between energizing pulses for the light emitting diode and the ringing pulses generated in response to the detection of the emitted light pulses by a solar photovoltaic cell; and FIG. 3 is a graph showing the relationship between the duty cycle of the light emitting diode and the minimum solar-cell peak current required to render an alarm.

DETAILED DESCRIPTION OF THE PREFERRED EMBODIMENT a. General Theory of Operation

The development of the preferred embodiment was initiated with an attempt to operate a LED light source at 60 Hz. This resulted in a unit of marginal sensitivity, because the amplifier gain is limited by input noise (mostly induced 60 and 120 Hz.) and the LED light output is limited by permissible peak current. Reliable operation of a LED dictates a high current limit for short duration pulses (less than 1 millisecond) and a much lower current limit for direct-current or long duration pulses (greater than 1 millisecond). The 1 millisecond limit is primarily determined by the thermal time constant of the LED junction. Consequently, driving an LED from half-wave 60 Hz. pulses places it under the lower current limit. Accordingly, a separate generator is required to increase the sensitivity of a smoke detector system by using high-current, low-duty cycle pulses to energize the LED.

The generator, a free-running multivibrator A (FIG. 1) energizes LED 1 with pulses having a pulse-repetition frequency of approximately 80 Hz. and approximately 5% duty cycle. The light pulses generated by LED 1 are applied to solar cell SC1 when smoke enters a Tyndall type detector chamber, not shown.

The photovoltaic output of the solar cell is a series of pulses corresponding to the energizing pulses (FIG. 2, upper waveform) applied to the LED. This output is applied to the input of a bandpass amplifier having an approximate 500 Hz. passband centered about 1000 Hz.

The low duty-cycle pulse output from the LED having a pulse-repetition frequency of 80 Hz. is successfully used as an input to bandpass amplifier B centered around 1000 Hz. The 1000 Hz. content of the light signal seen by the photocell 2 is negligible; however, amplifier B behaves as a tuned-resonant filter circuit and consequently is made to ring by a direct-current level change at the input. Every 0.6 millisecond signal pulse generated by solar cell SC1 is in effect a succession of two direct-current level changes. Each of these changes causes a damped oscillation at the output of the amplifier with a half period of 0.5 millisecond (FIG. 2, lower waveform). The two transients are in phase for a pulse length of 0.5 millisecond. Longer pulse lengths only affect the second, third and succeeding peaks, but not the first. Shorter pulse lengths affect the amplitude of the first peak, because the second transient arrives before the peak of the first has been reached, thus counteracting it.

Although ringing signal amplifiers, such as amplifier B, are known, its particular use in photodetecting circuits is new. The great advantage obtained is in higher sensitivities attainable, due to lower noise output of the narrow-band amplifier. The ringing amplifier circuit can easily be constructed with an active filter (or LC resonant circuit) of considerably smaller bandwith. As the passband is decreased, lower noise results and the resulting higher gain can be utilized to obtain a higher sensitivity. Sensitivity can be increased by a factor of 5 to 10 in this manner.

b. General Circuit Description

A detailed schematic diagram is shown in FIG. 1. The diagram is divided into 5 basic functional blocks A through E.

Block A is a conventional free-running multivibrator which drives LED 1 with pulses of 500 milliamperes amplitude. The pulse length is approximately 0.6 millisecond and the duty cycle approximately 5% (FIG. 2, upper waveform). The free-running frequency is approximately 80 Hz.

Block B is the photocell amplifier and contains 2 operational amplifiers in one envelope. The first section, AMP 1, is a current to voltage amplifier because solar photocell SC1 in the short circuit mode is basically a current source. The input impedance of AMP 1 is low, less than 200 ohms and the gain has the dimension of resistance, typically 30 megohms at resonance near 1000 Hz. Direct-current gain is very low and the amplifier operating point is very stable. High-frequency gain is attenuated by Miller feedback. The feedback circuit is simple. Its capacitors C1 and C2 cause the gain to fall off at frequency points above and below the center-frequency of 1000 Hz. for AMP 1. Since solar cell SC1 has a capacitance of approximately 2500 pf., this value needs to be considered in the analysis of the performance. The feedback filter makes AMP 1 operate as an active filter, resonating at approximately 1000 Hz. with a bandwidth of approximately 500 Hz.

The second section, AMP 2 of block B is a conventional voltage amplifier, with a gain of 1000 at its center frequency. This section has low frequency degeneration due to the coupling capacitor C3 and high-frequency degeneration due to Miller feedback capacitor C4.

The overall bandwith of block A is approximately 400 Hz. Bandwith is so limited in order to obtain a signal to noise ratio at the alarm level of at least 3:1. Noise of the system is predominantly due to solar cell SC1.

Block C is a peak threshold voltage detector which uses transistor Q1 as the rectifying element (base-emitter junction) and diode D1 for direct-current restoration. The base-emitter junction of Q1 is biased to 3.5 volts across R1 so that a threshold is obtained. The alarm signal must exceed this threshold and noise has to fall below. The output signal is taken from the collector of Q1; hence, any direct-current level change between the detector and the flip-flop of block D does not influence the alarm point.

Block D is a flip-flop with two stable states. Two relays RL1 and RL2 are used, each with a single-pole, double-throw contact, as collector loads. This contact arrangement has the advantage that the current drain of block D remains constant; this is a necessity to keep output voltage of the high impedance power supply constant. The output capacitor C5 of block C assures that flip-flop D at switch on starts in the set (no alarm) condition as long as no signal appears at the output of amplifier B. Pushbutton PB1 shorts capacitor C5 to reset the circuitry to a no alarm condition.

Block E is the power supply needed only for alternating-current operation (115v., 60 Hz.). A series capacitor C6 (1.8 mf. 200 v.) drops the line voltage without heat dissipation. A relay RL3 is connected to the direct-current output to indicate a power-supply output voltage. A shunt stabilizer utilizing components R2, R3, Q2 and Z1 is included in power supply E. The shunt stabilizer is normally not necesssary if severe line voltage variations are absent. Although the output impedance of the power supply is high due to series capacitor C6, the circuit load is essentially constant. Moreover, for a ±25% direct-current voltage change, the circuit sensitivity varies only by a few percent. This occurs because the amplifier and alarm circuit sensitivity is approximately inversely proportional to the threshold voltage of block C. Any variation in sensitivity is almost fully compensated by the variation in light output of LED 1. Both threshold voltage and light output are roughly proportional to direct-current output voltage from power supply E.

c. Detailed Description of Circuit Operation — No Alarm Condition.

When an alternating-current line voltage is applied to terminals 1 and 2, a regulated and filtered direct-current voltage appears at the various main terminals of the circuitry of FIG. 1, as indicated. LED 1 is energized by a pulse sequence generated by a free-running multivibrator A. The pulse sequence (upper waveform, FIG. 2) has a pulse-repetition frequency of approximately 80 Hz. and a duty cycle of approximately 5%. Accordingly, each energizing pulse is approximately 0.6 millisecond long. LED 1 generates corresponding light emission pulses. However, these pulses are not received by solar cell SC1, because LED 1 and SC1 are not light coupled without smoke in a Tyndall-type, smoke-detector chamber (assuming smoke is not present in the chamber). Therefore, photovoltaic solar cell SC1 does not apply an input voltage to bandpass amplifier B.

The threshold bias voltage developed across R1 is not overcome by a threshold output voltage from bandpass amplifier B. With this circuit condition, the collector circuit for transistor Q2 is nonconducting and that of transistor Q3 is conducting. Accordingly, in the no alarm standby condition of the detector circuitry of FIG. 1, alarm relay RL1 is deenergized and standby relay RL2 is energized. The normally open contact rL2 of relay RL2 is therefore closed. An annunciator lamp circuit may be connected to this contact, if desired, to indicate a standby condition of the detector.

d. Detailed Description of Circuit Operation — Alarm Condition.

In the event smoke enters the Tyndall-type, smoke detector chamber, light from LED 1 is reflected off the smoke particles to impinge upon solar cell SC1. A pulse sequence is accordingly generated by SC1 and is applied to the minus (−) and plus (+) terminals of AMP 1. The applied voltage has a waveform which substantially corresponds to the waveform of the energizing current for LED 1 (upper waveform, FIG. 2). The stepped input voltage of AMP 1 causes this stage to ring producing a damped oscillation pulse sequence corresponding to the lower waveform of FIG. 2. Because feedback components C1, C2, R4, R5, R6 and the capacitance of photocell SC1 convert AMP 1 into a bandpass ringing amplifier having a center frequency at about 1000 Hz. with a passband of about 500 Hz., the first half-wave of each ringing pulse sequence has a fundamental frequency of about 1000 Hz. or a time duration of about 0.5 millisecond. In view of the fact that input pulse to AMP 1 has a time duration of about 0.6 millisecond, the amplifier presents a substantial voltage gain to the first half-wave, but then attenuates the remaining portion of the ringing pulse sequence.

The ringing pulse output of the AMP 1 bandpass amplifier section is applied to the coupling network comprising potentiometer R7 and resistor R8. Coupling capacitor C3 transmits the AMP 1 output to the input of voltage amplifier section AMP 2. Components C3, R9 provide further low-frequency attenuation and components C4, R10 and R11 provide further high-frequency attenuation. The passband for the two amplifier sections comprising AMP 1 and AMP 2 is thus reduced from approximately 500 Hz. for AMP 1 alone to approximately 400 Hz. With the passband so limited, a signal to noise ratio at the alarm threshold level is at least 3:1.

The greatly amplifier first half-wave of each ringing pulse sequence is applied to the base-emitter junction of peak detector transistor Q1. This half-wave is a negatively directed pulse because the positively directed output pulse appearing at the P terminal of SC1 is applied to the inverting terminal (−) of AMP 1. There is no signal inversion in AMP 2 because the input signal is applied to the noninverting input terminal (+).

When the negatively directed pulse is applied to the base-emitter junction of Q1 through coupling capacitor C7 and the approximately 3.5 volt threshold bias appearing across R1 is overcome, the collector of Q1 begins to conduct.

With this occurrence, C5 begins to charge by current flow from the positively going collector of Q1. After only a few input pulses are applied to the base of Q1, C5 is fully charged to a voltage proportional to the peak voltage applied to the base of Q1. C5 has a typical capacitance value of 47 microfarads and R11 a resistance value of 3300 ohms. These component values present a relatively long discharge time constant which enables C5 to maintain a substantially constant voltage between successive charging pulses.

The positive voltage appearing across capacitor C5 causes the collector of the normally-off transistor Q2 to conduct throgh diode D2 and the relay coil of RL 1. The normally-open contact of rL1 thus closes, thereby completing an annunciator or alarm energizing circuit indicating the detection of smoke. Diode D2 may be a light emitting diode to visibly indicate an alarm at the detector site. In view of the fact that Q2 and Q3 and the associated circuit components comprise a bistable flip-flop, Q2 will continue to conduct until circuit reset pushbutton PB1 is manually closed. When PB1 is closed, C5 is shorted, thereby discharging to zero voltage. This causes Q2 to turn off and Q3 to turn on. The alarm circuit incorporating the normally-open contact of rL1 is thus opened causing a cessation of the smoke alarm or annunciator signal.

When an energizing voltage is first applied to bistable flip-flop D with a no-smoke condition, capacitor C5 also serves the function of holding the base to emitter voltage of Q2 to a zero value, thus assuring that Q3 will be on and Q2 will be off. This is the standby no-alarm condition of the circuitry. Relay RL1 is deenergized and relays RL2 and RL3 are energized. The closing of the normally-open contacts rL2 and rL3 close annunciator circuits (not shown) which show that bistable flip-flop D is in its standby condition and power is applied to all circuits.

Free-running multivibrator A employs transistors Q4, Q5 and Q6 with transistors Q5 and Q6 connected in a Darlington circuit. The energizing pulses for LED 1 (upper waveform, FIG. 2) must supply a relatively high peak current of the order of 500 milliamperes to LED 1. The total collector currents of Q5 and Q6 easily supply such peak currents. Timing components C8, C9, R13 and R14 provide an approximately 5% duty cycle for LED 1 with a pulse-repetition frequency of approximately 80 Hz. Accordingly, the time interval between successive pulses is approximately 12.5 milliseconds with each LED 1 energizing pulse having a time duration of approximately 0.6 millisecond.

Power supply E supplies a regulated maximum direct-current voltage of about 25 volts to the circuitry. The full-wave output of rectifier diodes D3, D4, D5 and D6 is regulated by the optional shunt regulator comprising components Z1, Q2, R3 and R4 and filtered by capacitor C10. The 25 volt power supply voltage is divided by the resistor network R15, R16, threshold bias resistor R1 and R17. Divided voltages of 20 volts and 10 volts are appropriately supplied to blocks B and C. Capacitors C11 and C12 further filter the divided voltages appearig at the 10 volts and 20 volts taps.

The graph of FIG. 3 shows the relationship between the minimum solar cell SC1 peak current to effect an alarm with respect to variations in duty cycle for two different solar cell output pulse lengths, namely, 0.5 millisecond and 0.8 millisecond. The 0.5 millisecond curve and the 0.8 millisecond curves merge and overlap when the minimum peak current is between 0.5 and 0.6 nanoampere. The graph shows that for all practical purposes the shorter pulse length of 0.5 millisecond has a circuit sensitivity which is essentially flat and independent of a duty cycle in the range of 10 percent to 50 percent, and that with a duty cycle range up to 10 percent the circuit sensitivity is essentially independent of solar cell output pulse length; while with a duty cycle in the range of 10 percent to 50 percent with the longer pulse length of 0.8 millisecond, the circuit sensitivity increases somewhat but not significantly. These curves, therefore, establish the general theory previously set forth.

It should be understood that the above described circuitry is merely illustrative of the principles of this invention, and that circuit changes can be made without departing from the scope of the invention. For example, the output pulse of the ringing amplifier may be used directly to reset the bistable flip-flop in response to a single pulse without a peak voltage detector.

What is claimed is:

1. In a particulate products of combustion detector having a light emitting solid state element and a photocell light coupled one to the other to serve as a particulate sensor, the improvement comprising means periodically pulsing the light element to corresponding pulses of light emission at a first pulse-repetition frequency, a ringing amplifier having an input circuit and an output circuit with the photocell connected to the input circuit to generate at the output circuit a ringing pulse output having the same pulse-repetition frequency as that of the light element emissions in response to the detection of the particulate products of combustion, and means connected to the output of the ringing amplifier to generate a signal indicative of the detection of the products of combustion.

2. The combination of claim 1 in which each ringing pulse is a damped oscillatory signal having a first waveform alternation of a time duration approximately equal to that of the pulse of light emission producing the ringing pulse.

3. The combination of claim 1 in which each ringing pulse is a damped oscillatory signal having a first waveform alternation of a time duration slightly shorter than that of the pulse of light emission producing the ringing pulse.

4. The combination of claim 3 in which the ringing amplifier is a bandpass amplifier centered about a frequency equal to that of the damped transient.

5. The combination of claim 1 in which the ringing amplifier is a bandpass amplifier having a passband centered about a frequency substantially higher than the first pulse-repetition frequency.

6. The combination of claim 4 in which the passband center frequency is about 1000 Hz. and the pulse repetition frequency of the light emitting pulse is approximately 80 Hz.

7. The combination of claim 4 in which the pulse repetition frequency of the light emitting pulse is outside the passband of the ringing amplifier.

8. In a particulate products of combustion detector having a light emitting solid state element and a photocell light coupled one to the other to serve as a particulate sensor, the improvement comprising means periodically pulsing the light emitting solid state element to corresponding pulses of light emission having a first pulse-repetition frequency, a bandpass-ringing amplifier with a passband centered about a frequency substantially higher than the pulse-repetition frequency and having an input circuit and an output circuit with the photocell connected to the input circuit to generate at the output circuit a ringing pulse output having the same pulse-repetition frequency as that of the light element emissions in response to the detection of the particulate products of combustion, a detector connected to the output of the ringing amplifier to generate a peak voltage responsive and proportional to the greatest voltage amplitude of each ringing pulse, and signalling means connected to the peak voltage detector responsive to a peak voltage greater than a particular magnitude to generate a signal indicative of the detection of the products of combustion.

* * * * *